United States Patent [19]

Nilsson

[11] Patent Number: 4,672,762

[45] Date of Patent: Jun. 16, 1987

[54] SAFETY DEVICE IN A REPEATING RIFLE

[76] Inventor: Carl O. L. Nilsson, Armfeldtsvägen 9, S-670 40 Åmotfors, Sweden

[21] Appl. No.: 728,584

[22] Filed: Apr. 29, 1985

[30] Foreign Application Priority Data

May 14, 1984 [SE] Sweden ..... 8402575
Jan. 7, 1985 [SE] Sweden ..... 8500044

[51] Int. Cl.[4] ..... F41C 17/08

[52] U.S. Cl. ..... 42/70.01; 42/70.11; 42/16

[58] Field of Search ..... 42/16, 1 LP, 70 R, 69 A

[56] References Cited

U.S. PATENT DOCUMENTS

| | | | |
|---|---|---|---|
| 41,115 | 1/1864 | Bean | 42/1 LP |
| 1,089,195 | 3/1914 | Falco | 42/70 R |
| 1,545,045 | 7/1925 | Dute | 42/16 |
| 1,568,635 | 1/1926 | Speer | 42/16 |
| 2,123,111 | 7/1938 | King | 42/16 |
| 2,824,402 | 2/1958 | Fischer | 42/70 R |
| 3,553,877 | 1/1971 | Welch et al. | 42/70.11 |
| 4,261,127 | 4/1981 | Karkkainen | 42/1 LP |

FOREIGN PATENT DOCUMENTS

| | | | |
|---|---|---|---|
| 406311 | 7/1934 | Belgium | 42/16 |
| 365139 | 3/1906 | France | 42/16 |
| 5483 | of 1889 | United Kingdom | 42/16 |
| 18242 | of 1913 | United Kingdom | 42/70 R |

*Primary Examiner*—Deborah L. Kyle
*Assistant Examiner*—Michael J. Carone
*Attorney, Agent, or Firm*—Murray and Whisenhunt

[57] ABSTRACT

The invention relates to a device in a repeating rifle with a cylinder bolt mechanism with a receiver and a bolt, comprising a bolt body with a mainspring and a firing pin, a rotatable bolt head, a handle, and in the receiver studs or some corresponding locking means interacting with the bolt head. A lockable lock (15) is arranged in the cylinder mechanism, said lock when in its locking position preventing the bolt head (9) from being turned from its position in engagement with said studs or corresponding locking means (4) in the receiver (2), thereby preventing the gun from being opened, i.e. the bolt (1) from being moved rearwards in the receiver (2).

8 Claims, 21 Drawing Figures

SAFETY DEVICE IN A REPEATING RIFLE

TECHNICAL SCOPE

The invention relates to a device in a repeating rifle with a cylinder bolt mechanism with a receiver and a bolt, comprising a bolt body with a mainspring and a firing pin, a rotatable blt head, a handle, and in the receiver, locking means interacting with the bolt head.

PRIOR ART

Occasionally, but rarely, guns are provided with a keyhole lock to prevent unauthorized access to the gun. For example, it is known in the art to put a lock in the trigger guard, making the gun unusable to anyone who does not have access to the key to the lock and can remove the lock. In the art it is also known to arrange locking devices extending through the butt into the cylinder mechanism blocking it. These technical solutions have in common that they presuppose special locking devices which must be mounted on or in the gun when locking it, and must be kept by the user when the gun is used. This is felt to be impractical which is probably the prime reason for the fact that their use is limited.

DISCLOSURE OF THE INVENTION

The object of the invention is to provide an improved device for the prevention of unauthorized use of repeating rifles, in the interest of crime prevention and accident prevention. The invention is characterized in that the device comprises a keyhole lock, arranged in the cylinder mechanism where it prevents, when locked, the bolt head from being turned out of its engagement with the studs in the receiver, whereby the gun is barred from being opened, ie the bolt from being moved rearwards in the receiver. Preferably the lock in the cylinder mechanism comprises a lock plunger which when in locking position prevents the firing pin and the bolt body to move axially relative to one another, thereby barring the handle from moving from its locking position. According to a preferred embodiment the lock is a cylinder locked arranged in the centre of the rear end of the bolt, the lock plunger extending radially outwards in the mechanism. Instead of cylinder lock, one could conceive of a combination lock performing the same function, but in this text the expression cylinder lock will be used for simplicity, to avoid confusion with reference to the parts locking the bolt head and the studs in the receiver.

Another object of the invention is to provide a device which may be applied to a repeating rifle with a straight handle movement, so called straight pull action, but the invention is not limited to this field of application and may also be used with slight modifications with conventional repeating rifles with rotating handle movement.

Further objects and characteristics of the invention will become apparent from the appended claims and from the following description of preferred embodiments.

BRIEF DESCRIPTION OF DRAWINGS

In the following description of preferred embodiments, reference will be made to the attached drawings, in which

The bolt 1 consists of the following main parts, see FIG. 3: A bolt body 5 with a mechanism housing 6, covered by a lid 7, a bolt neck 8, rotatable in the bolt body 5, with a bolt head 9, a mainspring tube 10 with a firing pin 11 movable therein, a firing pin nut 12, a handle 13, a gear transmission arrangement 14 and a cylinder lock 15.

Figure 1:
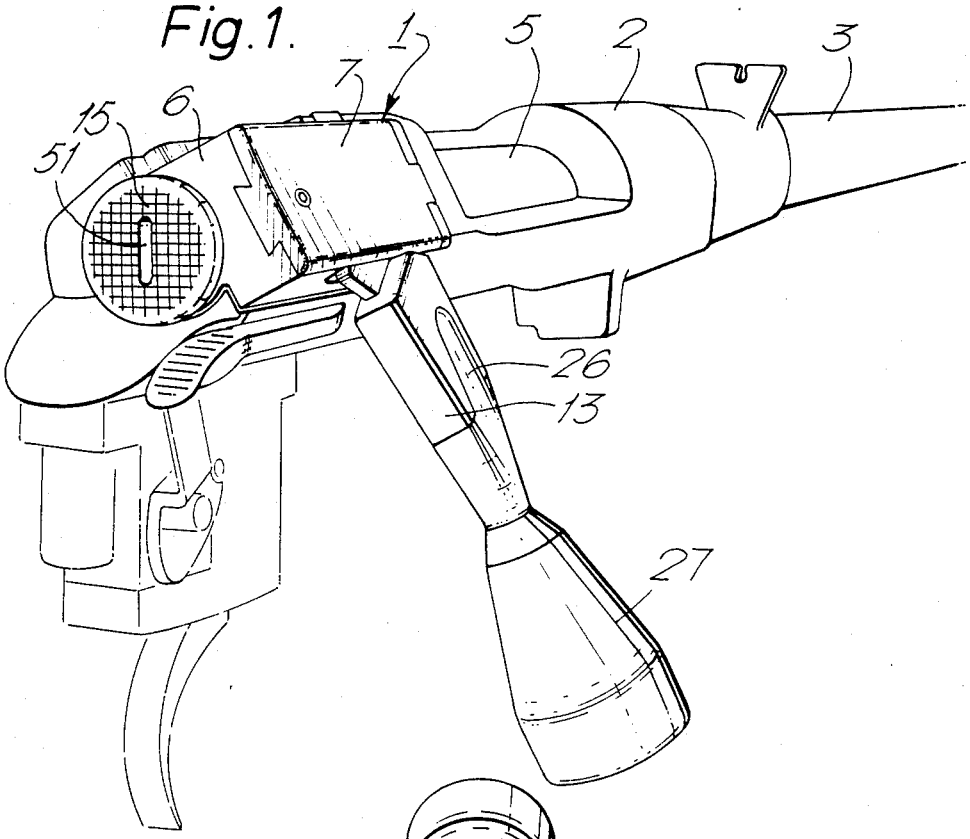
FIG. 1 is a perspective view of a first embodiment of a bolt mechanism and the receiver as viewed from the rear right side.

The bolt body 5 consists of a cylinder, the mechanism housing 6 being an integral part of this cylinder, constituting a projection thereon. More specifically, the mechanism housing 6, being generally a parallelepiped, extends at an angle upwards to the right in relation to a vertical plane through the centre line of the barrel. The inclination of the mechanism housing 6 to the vertical plane is about 55°, when the gun is directed normally. The bolt body 5 is provided with a central bore for the bolt neck 8, the mainspring tube 10 and the firing pin nut 12. At the front end the bolt 5 is provided with three claws 16, corresponding to three claws slots 17 between three studs 18, directed radially inwards in the locking ring 4 and forming a claw coupling which locks the ring 4 in the position determined by the bolt body 5 in a way known per se. The design of these parts is described in my aforesaid international patent application WO/8302153.

In the mechanism housing 6 there is a transverse guide 20 for a rack bar 21. The guide 20 is in the form of a groove in the housing, open at both long sides of the housing 6. The guiding groove 20 is bounded at the front side by a well 22 and at the back by the housing body 23. In the housing body there is a recess 24 fitted with a swivel pin 25 for the handle 13. The handle 13 is designed as a two-arm lever. The longer lever arm 26 extends from the bolt body 5 and has a grip 27. The shorter lever arm has been designated 28 and extends forward approximately at a right angle to the longer lever arm 26, in the form of a tooth 28 which fits in a slot 29 in the top side of the rack bar 21. A bearing arrangement between the two lever arms of the handle interacts with the swivel pin 25 and has been designated 30. Thus, the handle 13 swivels in a plane perpendicular to the swivel pin 5, the centre axis of which is in turn perpendicular to a plane coinciding with the centre line of the barrel and consequently with the firing pin axis. In other words, the swiveling plane of the handle 13 is parallel to said plane through the centre line, said plane being inclined at an angle of 35° to the vertical plane as the guns is held in a normal position aiming forward. The handle 13 can be turned through an angle of about 35° from a front position, in which the handle is directed directly outwards from the mechanism housing 6, and a rear position, in which the handle 13 is directed at an angle rearwards. The front position is bounded by a separating wall 31 between the recess 24 and a longitudinal groove 32 in the housing body 23 along the left side thereof. The rearward movement of the handle is limited by the front edge 33 of a right side wall 34 of the housing body 23. The two end positions are additionally determined by a stud 35 between the opening 36 in the side wall 34 accomodating the handle 13 and the guide 20. In the front wall 22 there is a front dovetail slot 37 and in the housing body 23 there is a rear dovetail slot 38 to accomodate dovetails 37' and 38', respectively, on the bottom side of the lid 7.

The longitudinal groove 32 along the housing boddy 23 forms a guide for a rotation stop 40. This is in the form of a bar equipped with an extension 41 directed sideways and guided in the groove 32, extending out through an opening in the left side wall 43 of the housing body 23. To the rear of rotation stop 40 there is a spiral spring 44 (rotation stop spring) arranged to press the rotation stop 40 forward. When barring rotation, the front tip 45 of the rotation stop 40 extends past the rear edge of the rack bar guide 20 into a cut 66 in the rack bar 21, thus when in this position preventing the rack bar 21 from moving from a right position to a left position. The extension 41 in this position is flush against the front edge of the opening 42, see FIG. 15. When the extension 41 has been pressed back in the opening 42 by a means devised to this end but not yet described, to the extent that the front tip 45 of the rotation stop has passed the rear edge of the rack bar guide 20 when moving backwards, the rack bar 21 may be moved to the left in the guide 20. Left in this connection signifies at an angle upwards leftwards and right signifies at an angle downwards rightwards, with respect to FIG. 1. The rack bar 21, the handle 13, the rotation stop 40 and the rotation stop spring 44 are locked in their respective places by the lid 7.

Figures 4, 5, 6, 7, 8, 9:
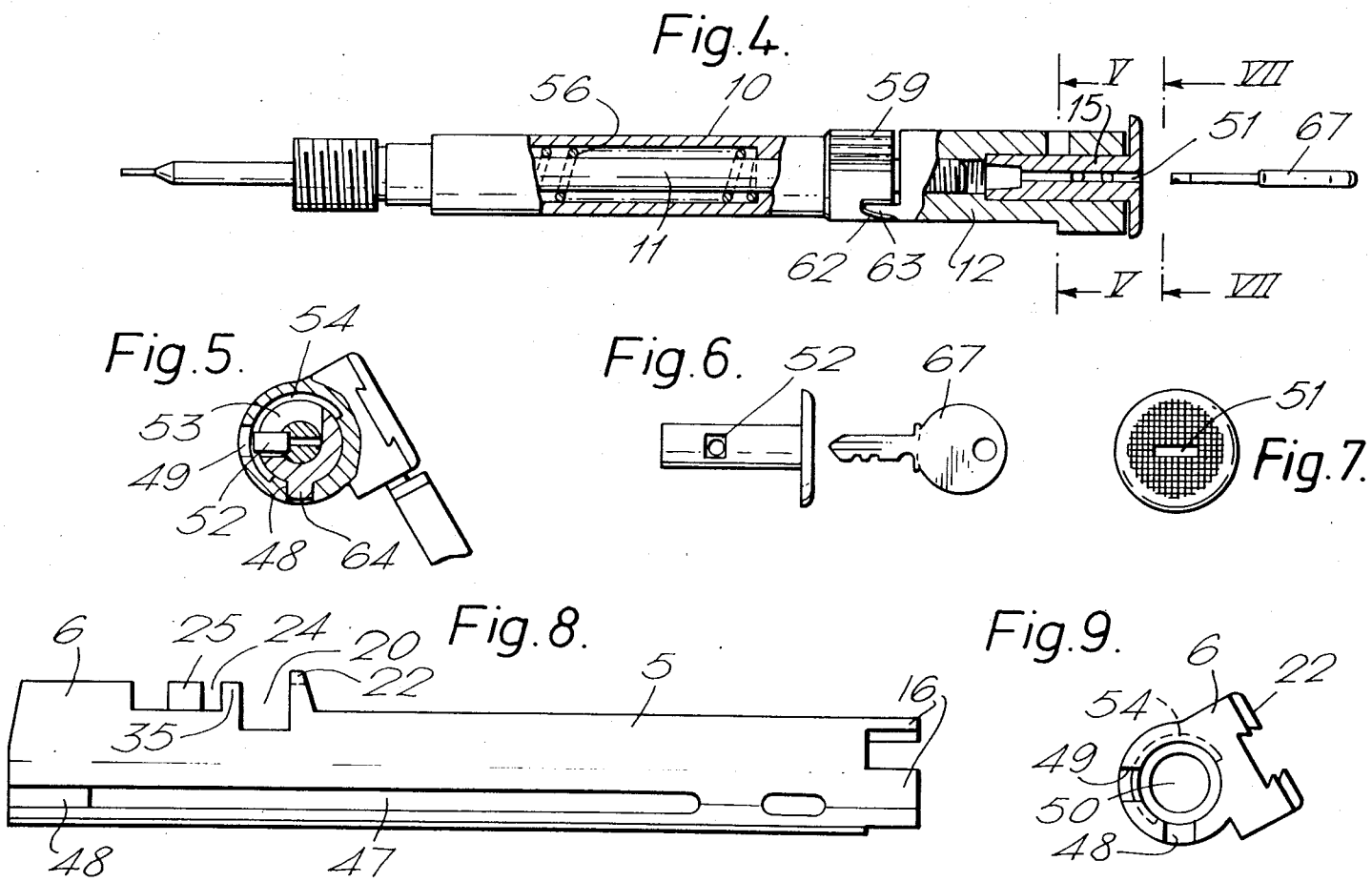
FIG. 4 is an elevation, partly sectional, of the firing pin with the mainspring, the mainspring tube, and the firing pin nut.
FIG. 5 is a sectional view corresponding to V—V of FIG. 4, the surrounding bolt body having been added to the drawing.
FIG. 6 is an elevation of a cylinder lock.
FIG. 7 is a view of the same cylinder lock, corresponding to VII—VII of FIG. 4.
FIG. 8 is an elevation showing the bolt body from the right.
FIG. 9 shows the bolt body from the rear.

On the bottom side of the bolt body 5 there is a guide slot 47, see FIG. 8, to accomodate the sear and at the rear end of the bolt body 5 there is a first recess 48, coinciding with the guide slot 47, and a second recess 49 at the left side of the bolt body 5.

Figure 10:
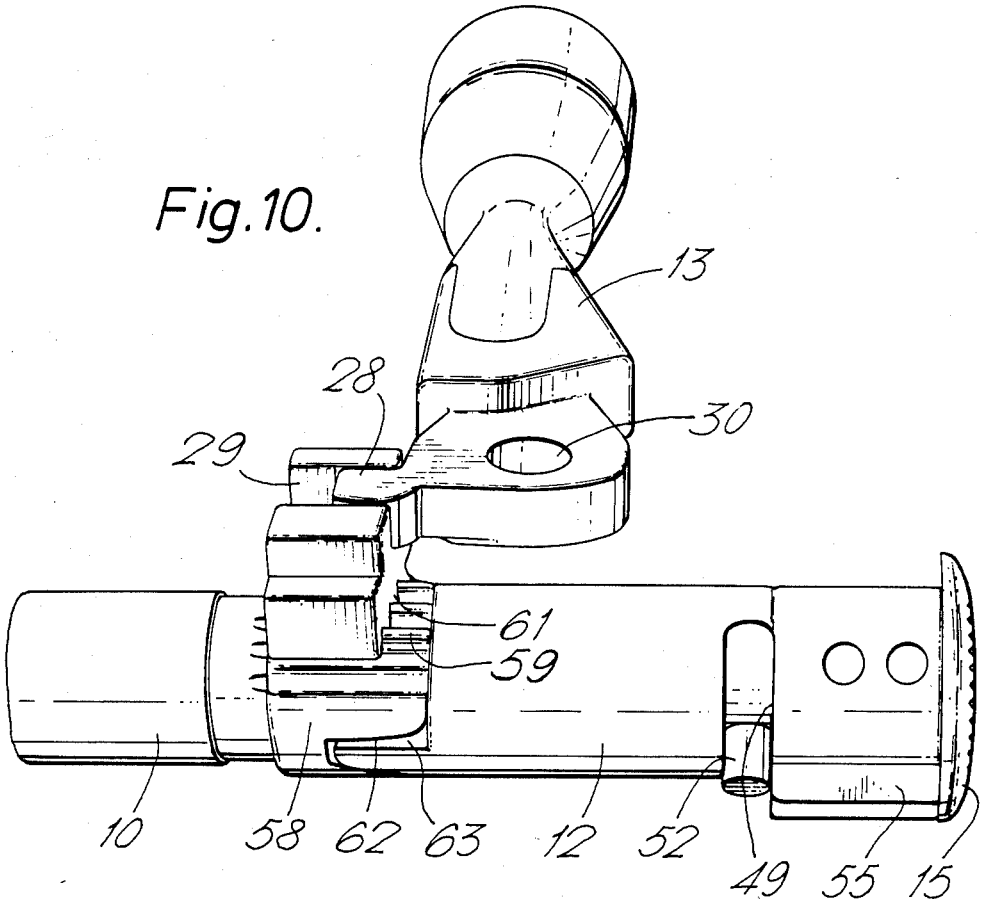
FIG. 10 is a perspective view on a larger scale of the means for turning the bolt head and compressing the mainspring.
Figure 11:
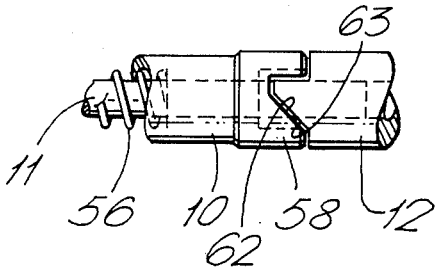
FIG. 11 shows the rear part of the mainspring tube, the front end of the firing pin nut, and a pair of guiding curves of said parts.

The firing pin 11 extends through the mainspring tube 10 and is screwed to the firing pin nut 12 at its rear end. The nut is provided with a central bore 50 to accomodate the cylinder lock 15, see FIGS. 5, 6, 7 and 9. A key hole has been designated 51, a lock plunger 52, and a key 67. The lock plunger 52 may be turned in a slot 53 in the firing pin nut 12 and a slot 54 in the inside of the bolt body 5 from a position wherein the lock plunger 52 is situated in the slot 49 in front of a specially arranged tooth 55 at the rear end of the firing pin nut, see FIG. 10, to a locked position at a right angle to the said first position, in other words approximately opposite the first recess 48 and the tooth 55 on the firing pin nut 12, said tooth being situated in said first recess. In this first, unlocked position, the firing pin assembly (firing pin, firing pin nut, and mainspring tube) may be moved into and out of the bolt body as the lock plunger 52 moves in or out, respectively, through the recess 49. In the locked position, however, the firing pin assembly is locked in the bolt body 5 by the lock plunger 52 being confined in the slot 54 on the inside of the bolt body 5. In this context it should also be noted, that the slot 54 on the inside of the bolt body 5 is situated in that part of the bolt body 5 which is near the lock plunger 52 when the lock plunger 52 is in its forward position relative to the bolt body, in other words when the mainspring 56 is not compressed. When the mainspring 56 has been compressed, the firing pin nut 12 has been moved rearwards relative to the mainspring tube 10 in a manner to be described later. In this position, the gun cannot be locked, since the lock plunger 52 when in this position no longer coincides with the slot 54 on the inside of the bolt body 5.

Figure 12:
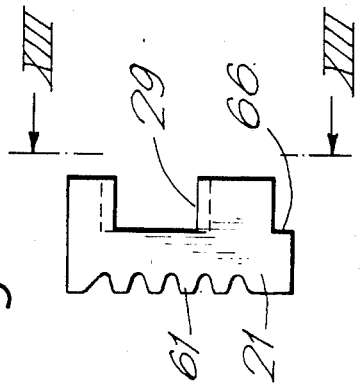
FIG. 12 shows the back side of a rack bar.

The front end of the mainspring tube 10 is threaded, so that the firing pin assembly depicted in FIG. 4 may be screwed to the bolt neck 8. To accomplish this, the former is entered into the bolt bodys 5 from the front end, while the firing pin assembly is entered into the bolt body 5 from the rear, and the two parts are then screwed together inside the bolt body. The rear parts 58 of the mainspring tube 10 has the same external diameter as the firing pin nut 12. One of its two halves is designed as a sector of a pinion 59. This sector is exposed and extends up through an opening 60 in the bolt body 5 in the area of the rack bar guide 20, in such a way that the pinion sector can interact with the teeth 61 on the bottom side of the rack bar 21, see FIGS. 10 and 12. The rear part 58 of the mainspring tube 10 is provided with a compression cam 62 corresponding to and interacting with a compression cam 63 on the firing pin nut 12, so that as the mainspring tube 10 is made to rotate about its axis by means of the transmission 14 (the firing pin nut 12 is barred from turning by the sear catch 64 and the tooth 55 entering their respective slots 48 and 49), the two compression cams will slide against one another whereby the firing pin nut 12 will be pressed rearwards, the mainspring 56 simultaneously being compressed in the mainspring tube 10.

Figure 2:
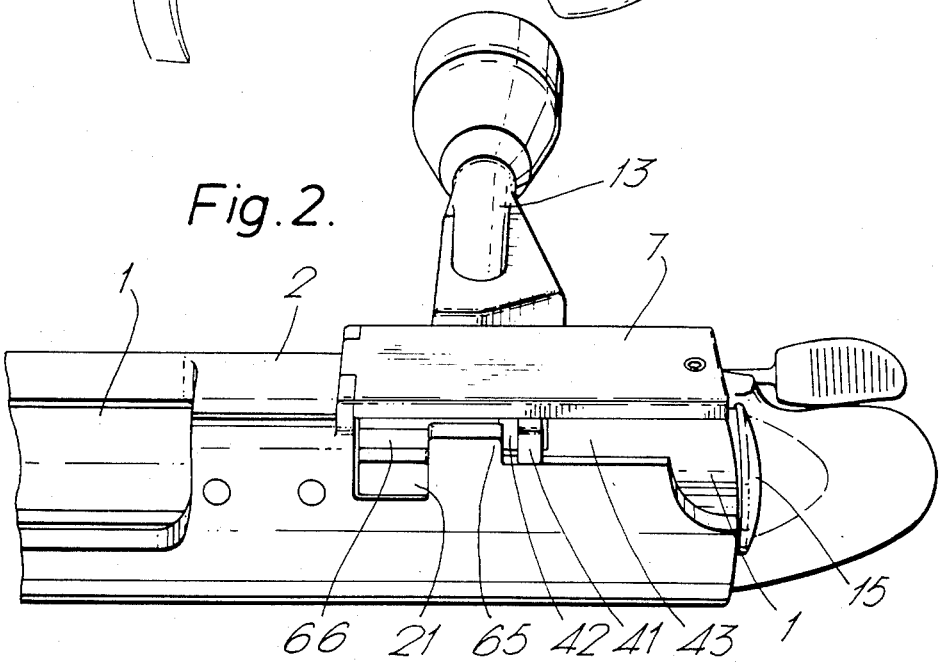
FIG. 2 is a plan view of the same mechanism.
Figure 3:
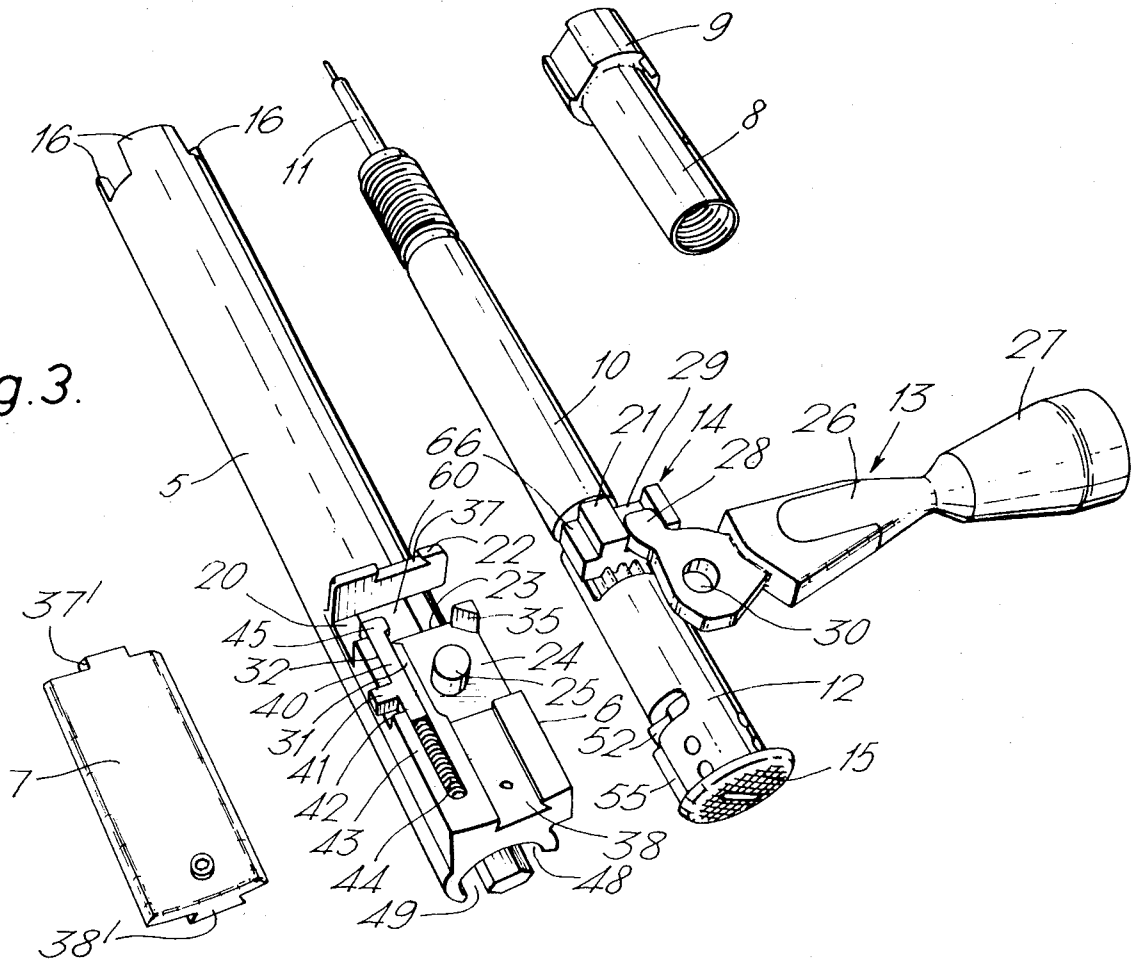
FIG. 3 is an exploded view of the main parts of the bolt.
Figure 14:
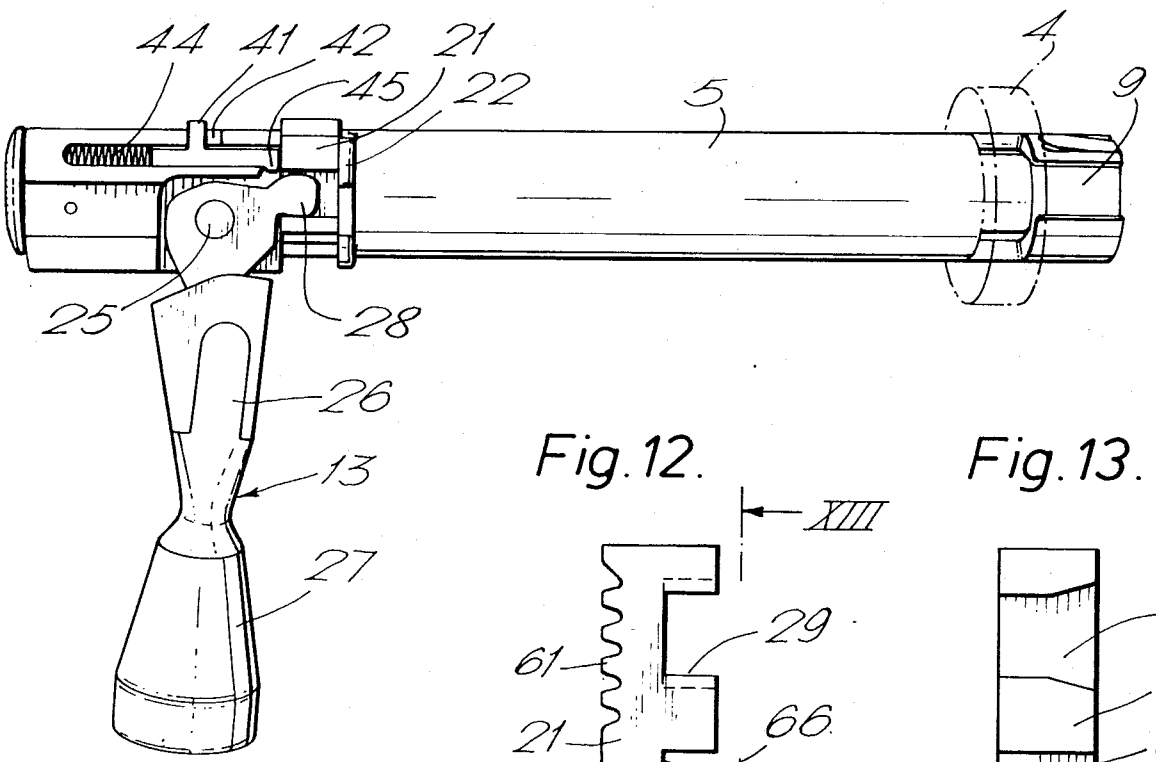
FIG. 14 shows the bolt with the bolt head locked, the gun having been fired but the spring not yet compressed.
Figure 13:
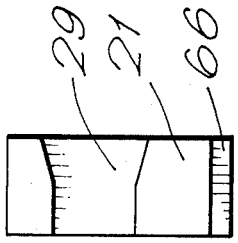
FIG. 13 is a view of the same rack, the view corresponding to XIII—XIII of FIG. 12.
Figure 15:
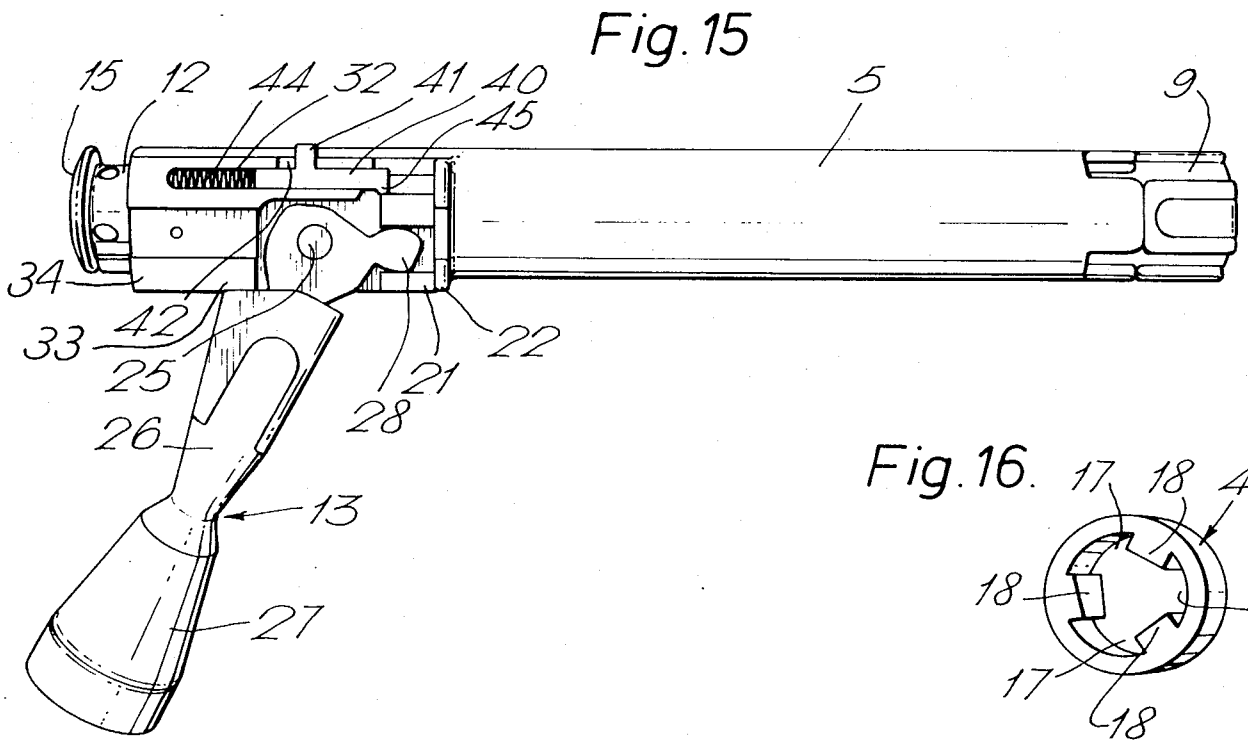
FIG. 15 shows the same parts after the mainspring has been compressed and the bolt head turned to neutral position.
Figure 16:
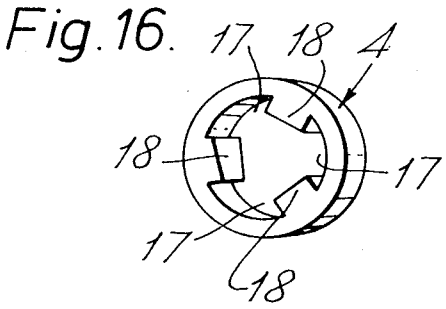
FIG. 16 is a perspective view of a locking ring of a construction previously known per se, being a part of the system.

Said rotation of the mainspring tube 10 is accomplished by means of the handle 13, as the handle is moved rearwards from its front position towards its rear position, pivoting about the swivel pin 25. By the leverage applied by the handle the tooth 28 in the slot 29 in the rack bar 21 is moved "rightwards". Thus, the rack bar 21 is moved to the right as the handle is pulled back about the pivot/swivel pin 25, the rack bar 21 by interacting with the pinion sector 59 of the mainspring tube 10 turning the tube clockwise. As the mainspring tube 10 turns, the mainspring 56 is compressed as the two compression cams 62, 63 are pushed and slide against one another as was described above, and as the mainspring tube 10 turns, the bolt neck 8 also turns and hence the bolt head 9 as well. When the turning has been completed, ie when the handle 13 has been brought to its rearmost position, the firing pin tube 10 and hence the bolt head 9 have been turned approximately 60° as a result of the gear ratio of the transmission 14, bringing the studs 18 on the bolt head 9 in coincidence with the claws 16 on the bolt body, the bolt head thereby becoming free to move into and out of the locking ring 4. The starting position before the mainspring is compressed and before the bolt head has been turned to its free position is illustrated in FIG. 14, while FIG. 15 shows the handle in its rearmost position, the mainspring being compressed (note that the firing pin nut has been moved rearwards from the mechanism housing 6) and the bolt head 9 being turned to its free position. In this position the bolt 1 may be moved rearwards in the receiver 2 to allow a new cartridge to be entered into the cartridge chamber. During this procedure, the handle 13 remains in its rearmost position, see FIG. 15. The bolt head is introduced into the locking chamber in the rear part of the barrel (see my international patent application W083/02153), the claws 16 on the bolt body entering the claw slots 17 in the locking ring 4. During this entire procedure, the handle 13 is prevented from swiveling forwards by the front tip 45 of the rotation stop 40 extending into the rack bar guide 20 and locking the rack bar 21. Only at the very end of the procedure, the rotation stop 40 is moved aside as the extension 41 hits a stop 65 at the left side of the receiver 2, see FIG. 2, thereby being moved rearwards in the opening 42. Finally, the rotation stop leaves the rack bar guide 20. The handle 13 may now be moved forward, turning about the swivel pin 25, and via the rack transmission 14 move the rack bar 31 leftwards, turning the mainspring tube 10, the bolt neck 8, and the bolt head 9, the bolt head being moved into locking position in front of the locking ring 4. In this position, the mainspring is already compressed, since it was compressed when the gun was opened.

It is natural that the design of the mechanism can be modified within the spirit and scope of the invention. Below some modifications will be described with reference to FIGS. 17–21. The amendments, which are believed to be improvements over the first embodiment described above, relate both to the lock-and-key mechanism, making it entirely proof against attempts to pick the lock or to break it open, and to the transmission means transforming the turning movement of the handle into the turning of the bolt head relative to the bolt body.

Figure 17:
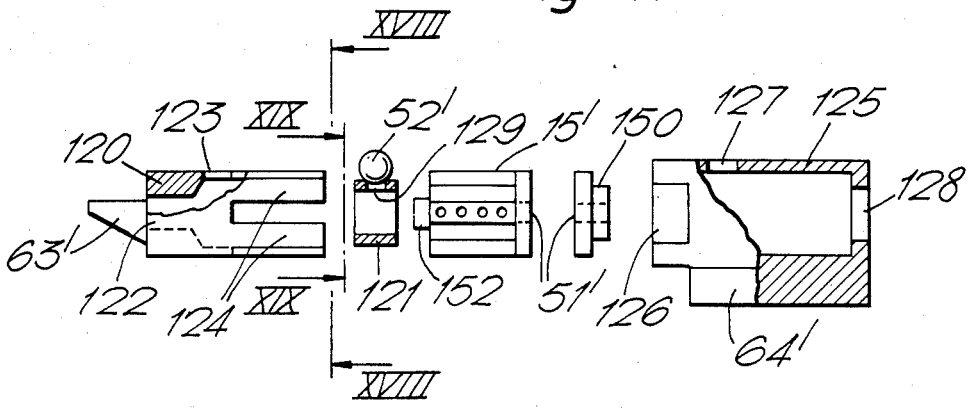
FIG. 17 is an exploded view of a firing pin nut fitted with a cylinder lock according to a second embodiment.
Figure 18:
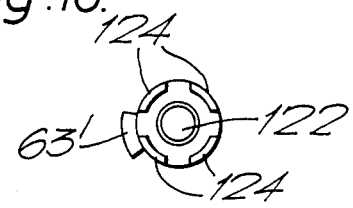
FIG. 18 is a view corresponding to XVIII—XVIII of FIG. 17, a rear view of a lock case with a safey cam.
Figure 19:
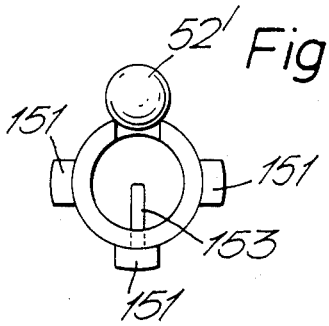
FIG. 19 is a view corresponding to XIX—XIX of FIG. 17, a rear view of the cylinder lock, a pin, and a locking ball on a larger scale.
Figure 20:
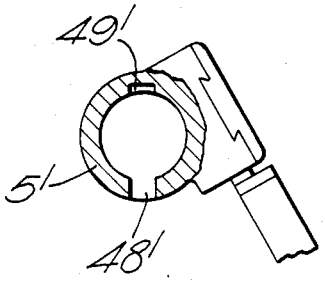
FIG. 20 is a transverse sectional view of the second embodiment of the bolt body in the area of the locking ball.
Figure 21:
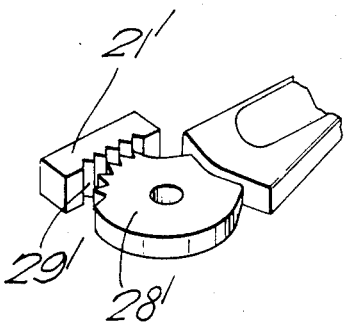
FIG. 21 is a perspective view of part of the transmission of the second embodiment.

The firing pin nut fitted with a cylinder lock shown in FIG. 17 comprises a lock sleeve 120 with a compression cam or safety tooth 63', a dog sleeve 121 with a locking ball 52', resting in a hole 129 of smaller diameter than the ball 52', a cylinder lock 15', a steel ring 150 and a socket 125 with a sear catch 64'. The lock sleeve 120 has a threaded bore 122 to accomodate the firing pin. In the wall of the lock sleeve there is a hole 123 for the locking ball 52', the hole diameter being slightly larger than that of the ball. The rear part of the lock sleeve 120 is designed as four claws 124 to be fitted over the cylinder lock 15', the outside of which is provided with four splines 151. In FIG. 19 one of these spline keys is obscured by the locking ball 52'. The cylinder lock 15' per se is in accordance with pior art and comprises in a known way a finger 152 to be entered into the dog sleeve 121 there to engage said sleeve by means of a pin 153, see FIG. 19. The cylinder lock 15' in accordance with prior art has a key slot 51' coinciding with a slot in the steel ring 150. In the front part of the socket 125 a notch 126 has been cut to acommodate the compression cam 63' and the side of the socket has a hole 127 for the locking ball 52'. When the device is assembled, the two holes 123 and 127 of the same size are coaxial. At the rear end of the socket there is an axial hole 128 to accommodate the steel ring 150. At assembly,a the steel ring 150 is placed from the inside in the hole 128, the cylinder lock 15' and the dog sleeve 121 are put into the socket 125, and the lock sleeve 120 is entered between the inside of the socket 125 and the cylinder lock 15', so that the spline keys 151 fit between the claws 124. The assembly is locked by a locking pin, not shown, through the front parts of the socket and lock sleeve walls. The bolt body 5', see FIG. 20, has a recess 48' to accomodate the sear catch 64', and directly opposite this recess 48' there is a recess 49' to acommodate the locking ball 52'.

The device described with reference to FIGS. 16–21 functions as follows. To lock the gun, a key is entered in the key slot 51'. When the key is turned to lock the gun, the locking ball 52' is lifted out of the hole 129 in the dog sleeve 121, as the finger 152 and hence the tubular dog sleeve 121 is turned 90° about the centre axis. The locking ball 52' is pressed radially outwards through the holes 123 and 127 in the lock sleeve and the socket 125, respectively, to enter the recess 49' in the bolt body 5', see FIG. 20. This locks the integrated firing pin nut 12' to the bolt body 5', barring these parts from moving relative to one another. It is impossible to drill the lock open from the key hole end, since the cylinder lock is made of hardened steel. Should an attempt be made to force the lock for example by sticking a screwdriver tip into the key hole and trying to turn it, this will only, if any turning takes place, result in the permanent fixation of the locking ball in its position. The only way to open the gun if this has happened is to make a hole radially directly outside the ball 52', such as by spark machining, but this would require both advanced equipment and special spark machining expertise, as well as a precise knowledge of the position of the locking ball 52'.

Referring now to the improved transmission means, this improvement comprises a modification of the rack bar, designated by reference numeral 21', and the shorter lever arm, designated 28'. The lever arm 28' is designed in the form of a sector of a pinion, and the rack bar 21' has been provided with teeth on that part also which faces the lever arm 28'. The bottom side of the rack bar 21' is still provided with teeth 61 interacting with the teeth 59 on the mainspring tube 10, see FIG. 10 of my previous patent application.

I claim:

1. Device in a repeating rifle with a cylinder bolt mechanism comprising a receiver and a bolt, having a rear part, disposed within said receiver; said bolt having an axis and comprising a bolt body, having a rear and an inside, a mainspring, a firing pin, a rotatable bolt head and a movable handle; said receiver including lock means, lockingly engageable with said bolt head, for locking said cylinder during firing; said firing pin being axially movable relative to said bolt body; said bolt being axially movable in said receiver to a foremost position;

wherein a cylindrical key-lock which can be locked and unlocked by means of a key is arranged in the center of said rear part of said bolt in said cylinder bolt mechanism with a key hole facing rearwards in said center of said rear part of said bolt, said key-lock comprising a lock plunger which is movable on said inside of said bolt body between a non-locking position and a locking position in which the lock plunger prevents the firing pin and the bolt body from moving axially relative to one another, thereby in consequence preventing said handle from being moved out of the position it takes when said bolt has been moved to said foremost position in said receiver and said bolt head has been brought into locking engagement with said lock means in said receiver;

wherein a slot is provided on said inside of said bolt body; and wherein a recess is provided at said rear of said bolt body such that said lock plunger is movable along said slot on said inside of said bolt body between a non-locking position, in which said plunger is situated in said recess at said rear of said bolt body, and a locking position, in which said plunger does not enter said recess.

2. Device in a repeating rifle with a cylinder bolt mechanism comprising a receiver and a bolt, having a rear part, disposed within said receiver; saisd bolt having an axis and comprising a bolt body, having a rear and an inside, a mainspring, a firing pin, a rotatable bolt head and handle means for rotating said bolt head; said receiver including lock means, lockingly engageable with said bolt head, for locking said cylinder during firing; said firing pin being axially movable relative to said bolt body; said bolt being axially movable in said receiver to a foremost position;

wherein a cylindrical key-lock which can be locked and unlocked by means of a key is arranged in the center of a part, inside said bolt body and integral with said firing pin, said part being axially movable inside the bolt body when the key-lock is in its non-locking position, and wherein said key-lock comprises a lock plunger, which when in locking position prevents said firing pin and said bolt body from moving axially relative to one another, thereby in consequence preventing said handle means from being moved out of the position it takes when the bolt has been moved to its foremost position in the receiver and the bolt head has been brought into locking engagement with said lock means in said receiver;

wherein said lock plunger is movable along a slot in said part, integral with said firing pin.

3. Device as claimed in claim 2, wherein said part is a firing pin nut.

4. Device as claimed in claim 2, wherein said firing pin has a center line extending along said bolt axis; and said handle means comprises a handle, linearly movable in a plane parallel to said firing pin center line, and transmission means, operably connected to said handle and said bolt head, for transforming the linear movement of the handle into rotary movement of the bolt head, when the key-lock is in its non-locking position.

5. Device in a repeating rifle with a cylinder bolt mechanism comprising a receiver and a bolt, having a rear part, disposed within said receiver; said bolt having an axis and comprising a bolt body, having a rear and an inside, a mainspring, a firing pin, a rotatable bolt head and handle means for rotating said bolt head; said receiver including lock means, lockingly engageable with said bolt head, for locking said cylinder during firing; said firing pin being axially movable relative to said bolt body; said bolt being axially movable in said receiver to a foremost position; wherein a cylindrical key-lock which can be locked and unlocked by means of a key is arranged in the center of a part, inside said bolt body and integral with said firing pin, said part being axially movable inside the bolt body when the key-lock is in its non-locking position, and wherein said key-lock comprises a lock plunger, which when in locking position prevents said firing pin and said bolt body from moving axially relative to one another, thereby in consequence preventing said handle means from being moved out of the position it takes when the bolt has been moved to its foremost position in the receiver and the bolt head has been brought into locking engagement with said lock means in said receiver; and further comprising compression cams arranged between said part, integral with the firing pin, and a second part, integral with said bolt head, said firing pin arranged to be moved axially rearwards by said compression cams as said second part, integral with the bolt head, is rotated by said handle means, said mainspring simultaneously being compressed; and when said key-lock is in its locking position said rearward movement of said firing pin, and consequently also said rotation of said bolt head and the opening of the gun, is prevented.

6. Device as claimed in claim 5, wherein said firing pin has a center line extending along said bolt axis; and said handle means comprises a handle, linearly movable in a plane parallel to said firing pin center line, and transmission means, operably connected to said handle and said bolt head, for transforming the linear movement of the handle into rotary movement of the bolt head, when the key-lock in in its non-locking position.

7. Device in a repeating rifle with a cylinder bolt mechanism comprising a receiver and a bolt, having a rear part, disposed within said receiver; said bolt having an axis and comprising a bolt body, having a rear and an inside, a mainspring, a firing pin, a rotatable bolt head and handle means for rotating said bolt head; said receiver including lock means, lockingly engageable with said bolt head, for locking said cylinder during firing; said firing pin being axially movable relative to said bolt body; said bolt being axially movable in said receiver to a foremost position;

wherein a cylindrical key-lock can be locked and unlocked by means of a key is arranged in the center of a part, inside said bolt body and integral with said firing pin, said part being axially movable inside the bolt body when the key-lock is in its non-locking position, and wherein said key-lock comprises a lock plunger, which when in locking position prevents said firing pin and said bolt body from moving axially relative to one another, thereby in consequence preventing said handle means from being moved out of the position it takes when the bolt has been moved to its foremost position in the receiver and the bolt head has been brought into locking engagement with said lock means in said receiver; and wherein said key-lock comprises a cylinder lock with a dog sleeve and a locking ball, said ball being pressable through a hole in said part, integral with said firing pin, into a recess in said bolt body as the dog sleeve is turned, thereby locking said part, integral with said firing pin, in relation to the bolt body, when the ball is in locking position, and as the dog sleeve is turned in the opposite direction disengaging said part, integral with said firing pin, and said bolt body is returning the locking ball to a non-locking position.

8. Device as claimed in claim 7, wherein said firing pin has a center line extending along said bolt axis; and said handle means comprises a handle, linearly movable in a plane parallel to said firing pin center line, and transmission means, operably connected to said handle and said bolt head, for transforming the linear movement of the handle into rotary movement of the bolt head, when the key-lock is in its non-locking position.

* * * * *